US005579614A

United States Patent [19]

Dorn

[11] Patent Number: 5,579,614

[45] Date of Patent: Dec. 3, 1996

[54] ACOUSTICAL SYSTEM, A PART THEREFOR AND METHOD OF MAKING SAME

[76] Inventor: Gordon J. Dorn, 806 S. First St., DeKalb, Ill. 60115

[21] Appl. No.: 582,170

[22] Filed: Jan. 2, 1996

[51] Int. Cl.[6] ..... E04B 1/82

[52] U.S. Cl. ..... 52/144; 52/145; 181/284

[58] Field of Search ..... 52/144, 145; 181/284, 181/285, 286, 295

[56] References Cited

U.S. PATENT DOCUMENTS 2,887,173 5/1959 Boschi ..... 52/145 X 5,331,567 7/1994 Gibbons et al. ..... 181/284 X

FOREIGN PATENT DOCUMENTS 549242 of 1958 Italy ..... 52/145

*Primary Examiner*—Creighton Smith

*Attorney, Agent, or Firm*—Mathew R. P. Perrone, Jr.

[57] ABSTRACT

An acoustical surface is formed by securing a series of half cones, preferably truncated, to a wall.

20 Claims, 1 Drawing Sheet

FIG. 5
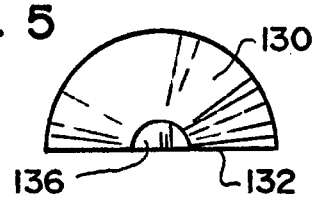
FIG. 1
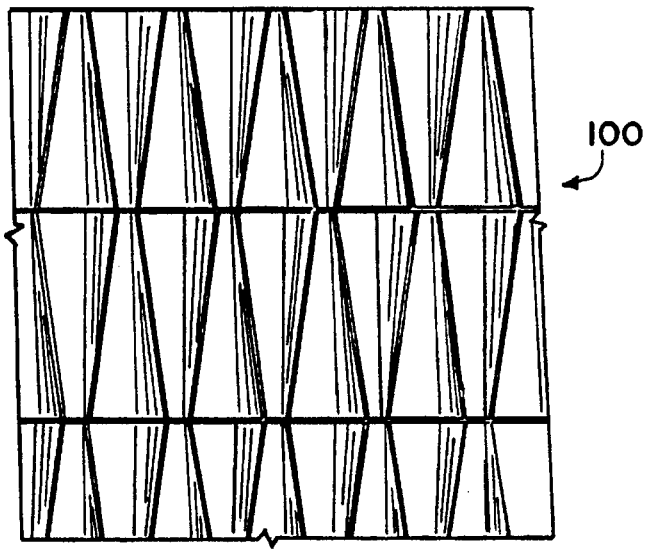
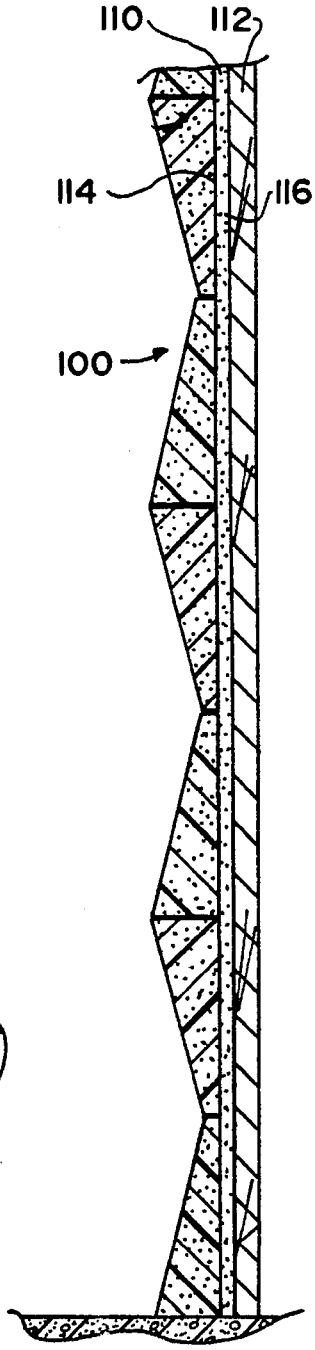
FIG. 2
FIG. 3
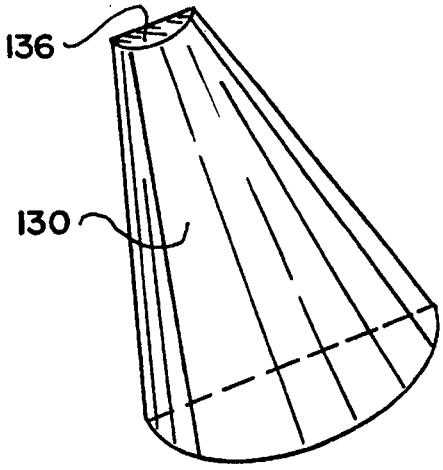
FIG. 4
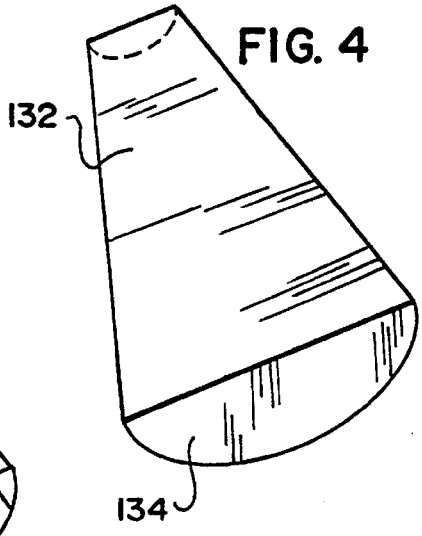

ACOUSTICAL SYSTEM, A PART THEREFOR AND METHOD OF MAKING SAME

This invention relates to an acoustical system and more particularly to a surface covering for walls of a room based on a cone shape applied thereto, which produces desirable acoustical results.

BACKGROUND OF THE INVENTION

It is desired to create acoustically acceptable rooms for listening to music and other desirable purposes. This is accomplished by putting various appropriately shaped members on otherwise flat walls and adjusting the acoustics in that fashion. Typically used are wedge-shaped blocks and other devices to disrupt the sound waves and avoid undue echoes in an area, where such echoes are not desired. Thus, as the sound waves are absorbed, the acoustics in the desired area can be improved.

Many different structures are known to accomplish this aspect of acoustic improvement. However, such items are difficult to install and do not provide appropriate reflection as desired.

Historically, the contemporary "media room", whether in the home or office, has historical roots and origin in the music and entertainment rooms of the past. The sixteenth and early seventeenth centuries provide a basis for the development of the chamber room within living quarters. The chamber room in turn is derived from an eating place to a place of musical and other forms of entertainment. Typical of the other forms of entertainment are parties, plays, and the like.

Architectural furnishings for these rooms include tapestries, inlaid woods, as well as an elaborate plaster work ceiling and plaster wall frieze. Such architectural features transform the acoustics in the room in such a manner as to create the very idea or concept of "chamber music".

In the eighteenth century, the notion of the salon, which is thus formed, is also sometimes referred to as the "music room". Music rooms or salons of the eighteenth century are usually treated profusely with molded plaster detail; creating acoustics useful for the presentation of music.

The music rooms of the eighteenth century, which may also be thought of as scaled-down versions of the medieval great hall, provide a basis for the "living room" during the Victorian era. Thus is developed the "living room" as the center of domestic entertainment. A Victorian living room leads to a, by now established, use of heavily molded plaster elements within the make-up of the "living room"; which remains the center for musical and other entertainment within the home.

In the twentieth century following World War II, the concept of the "family room" provides a replacement for the living room. The "family room" is a place where family and friends gather and are entertained. The "family room" thus becomes an informal place for leisurely pursuits, where togetherness can be practiced.

Electronic entertainment is developed at that time to alter the patterns of leisure and home life. Early radios and phonographs, often housed in elaborate and stylized cabinets, serve as the electronic "hearth" around which family members and friends can gather. This time, the larger elaborately stylized radio and phonographic cabinets produce some of the beneficial sound qualities, which were lacking within the new home construction techniques of the period.

Advances in high fidelity music serve as an integral part of life beginning in the late 1950's and 1960's. The record player, radio, television, and tape recorder transform the home of the fifties and early sixties. The advent of more equipment arouses a desire for more sophisticated integration of sound components within the home. By that time, a new attitude is in place, whereby component design is creating a specific use and design statement.

Home entertainment equipment acquires an array of lights, dials, toggle switches, and slide controls that more closely resembled the cockpit of a spaceship. Elaborate equipment becomes a new status symbol, emblematic of money and leisure. However, still not much had been accomplished with respect to the entire room. The most imaginative solutions simply place the equipment on shelves with speakers spaced apart.

The 1970's see a rise in home entertaining, as more audio and video systems come into the market. Ever more recent technology is producing new personal choice with respect to media options. New electronics will undoubtedly continue to expand the limits of entertainment, education, and information services within the home.

The architectural and design ramifications can be seen in the development and growing interest in building integrated home entertainment centers or "media rooms". "Media rooms" used for the exclusive purpose of audio-video entertainment must share a new compatibility with the electronic components themselves.

The architecture, lighting, seating, and placement of all types of acoustic features must be geared for acoustic as well as visual aesthetics. As these considerations grow in importance, electronic integration will reach a new level of sophistication within the home or office.

To create conditions for good optimum hearing conditions within a room, the following goals are important:

loudness shall be adequate;

there shall not be too much sound dampening material;

there shall be no perceptible echoes or focusing; and there shall be no undue reverberation.

Reverberation is the persistence of sound with gradually decreasing loudness owing to successive reflections from the boundaries of a room with comparatively little absorption at each reflection, and produces a sort of undercurrent or background above or against which the sound has to be heard. Excessive reverberation is the commonest of acoustic defects. The reverberant character of an empty house is well known and also the improvement that is effected by introducing furnishings.

A method whereby reverberation may be reduced is to reduce the number of plain unbroken surfaces, such as flat walls, which are subject to reverberation.

Simply stated, sounds are produced by mechanical vibrations. A vibrating object disturbs the molecules of air surrounding it, causing periodic variations in the air pressure. As the object vibrates back and forth, the pressure becomes alternately more and then less dense. These pressure variations radiate away from the object, eventually reaching the listener's ear, causing the sensation known as sound.

It is the constant aim of high-fidelity enthusiasts to achieve the ultimate in sound reproduction. The ultimate has not yet been achieved, and it is extremely unlikely that it ever will be. Nevertheless, it is certainly possible to approach very closely in one's own listening space the sound of a concert hall—from a subjective point of view.

Like the other senses, hearing is a subjective experience; and the way a person hears a piece of music is closely interwoven with the laws of physics. When sound is reproduced by way of loudspeakers, the experience is then also influenced by various electronic as well as environmental conditions.

The listening room is part of the audio chain between the loudspeakers and one's ears; every sound that reaches the listener must pass through the room and be altered by the conditions of the room. In addition to the room's structural configuration, it is the proportion and type of reflective to absorptive surfaces that will most affect the sound quality. It is generally understood that one's choice of a room may have more influence on the final sound than the choice of loudspeakers. For this reason the room itself becomes an important component. In most cases, unfortunately, it is the one that is the most usually forgotten.

Like any component, a listening room must have a reasonably flat frequency response in order to avoid screechy highs or boomy lows. In addition, it must be free of distortion in a physical sense to avoid buzzing or rattling. In addition, the listening room is an enclosed space where sound waves are reflected throughout the space onto the walls, floor, and ceiling. These frequencies, having wavelengths which fit most neatly into the dimensions of the space, are called natural frequencies of the room and constitute its natural "modes" of vibration.

The number of modes to be found in a space of any given dimensions depends essentially on the volume of the room. It is known, that if the modes of vibration are distributed in a more complex manner, such treatments will be particularly advantageous. Placement of absorptive material (such as furniture or carpet) and the shape of the absorptive as well as reflective surfaces (as with sculpturally modified walls) contribute to the diffuseness of the reflected sound. This simply means that sound bouncing off the walls tends to reach the listening area approximately equally from all directions.

Despite the advantages in making a listening room highly absorptive or "dead" space will not sound as loud as one playing in a reflective or "live" space, where the reverberation reinforces the direct sound from the speakers. The acoustics of a dead room may also be found to be dull and unpleasant.

A solution to such a situation is to have an appropriate mix of materials and benefits such as the proposed invention, which is created from hard or highly reflective material but through its particular shape is transformed into a more beneficial reflector; thus retaining the positive aspects of needed reflection. Such a structure does not exist.

Wall surfaces must reduce echo. Echo difficulty, admittedly minor with smaller spaces, can still be an annoyance. Echo difficulty is overcome through ensuring that the sound or reflection is dispersed in all directions.

For corporate use, the newest conference centers throughout the country are acknowledging the potential of video technology by incorporating such electronics into their design plans. The most successful solution not only accommodates the electronic need, but also the comfort level with respect to the quality of the room's acoustics as well as the overall aesthetic appearance of the overall image, which the corporation intends to project.

Listener fatigue is a function of certain forms of distortion produced by an audio system and is functionally the result of improper speaker placement. The listener may actually become tired after listening to the system for an unduly short period of time; one may even get headaches. Speakers are often the most serious potential offenders. Listener fatigue is best eliminated or reduced.

However, listener fatigue can also be a function of the sound-pressure level, a measure of the volume in decibels; and overly "bright" room with too many flat reflective wall surfaces will be too reverberant. The objective is to break up large areas of flat wall space with relief forms which will diffuse the sound or spread it out more evenly throughout a given space. Diffusion is the reflection of sound from an irregular surface.

Resonance is the naturally occurring frequency at which an object (for example a wall, air, or a loudspeaker) may be excited into motion. In loudspeakers unwanted resonances cause colorations in sound quality. Room resonance is a function of the dimensions and number of flat regular reflective surfaces within a room which may set in motion vibrations.

Reverberation is the perceived continuation of a sound resulting from its reflection off of generally flat regular exposed wall surfaces within a room which may set reechoed sound. In general wood as a coefficient of sound absorption is double that of ordinary plaster or, to state another way, plaster is twice as reflective as wood.

Some basic relative absorption coefficients for construction materials are as follows. For example according to the book, *Acoustic, A Handbook for Architects and Engineers* by Percy L. Marks, author; Copyright 1941; and published by Chemical Publishing Co., Inc., out of New York, N.Y., in the Chapel at the University of Illinois, Urbana, Ill., there is a room rectangular in shape. It measures, 76.5 feet, 59.5 feet long, 59.5 feet wide, and 17.75 feet high, with a volume of 80,800 cubic feet. The floor, benches and stage are constructed of wood while the walls and ceiling are of plaster. With no audience present, there are 740 units of absorbing material, as given in the tabulation:

| Material | Area | Coefficient | Absorption |
|---|---|---|---|
| wood | 6928 sq. ft.* | .061 | 423 units |
| plaster | 7440 sq. ft. | .033 | 246 units |
| metal | 628 sq. ft. | .01 | 6.3 units |
| glass | 408 sq. ft. | .025 | 10.2 units |
| seats | 550 sq. ft. | .1 | 55 units |
| | | TOTAL | 740 units. |

*square feet

SUMMARY OF THE INVENTION

Among the many objectives of this invention is the provision of a vertically split cone assembly to improve the acoustics in a room.

A further objective of this invention is the provision of an acoustic assembly to reduce reverberation in a room.

A still further objective of this invention is the provision of an acoustic assembly to reduce resonance in a room.

Yet a further objective of this invention is the provision of an acoustic assembly to reduce listener fatigue in a room.

Also an objective of this invention is the provision of an acoustic assembly to reduce loudness in a room.

Another objective of this invention is the provision of an acoustic assembly to reduce perceptible echoes in a room.

Still another objective of this invention is the provision of an acoustic assembly to reduce focusing in a room.

Yet another objective of this invention is the provision of an acoustic assembly to promote sound diffusion in a room.

An additional objective of this invention is the provision of an acoustic assembly to promote an entertainment center in a home.

A further objective of this invention is the provision of an acoustic assembly to promote a proper acoustic for a business meeting room.

A still further objective of this invention is the provision of a method to improve acoustics in a room.

Yet a further objective of this invention is the provision of a method for installing an acoustic assembly in a room.

These and other objectives of the invention (which other objectives become clear by consideration of the specification, claims and drawings as a whole) are met by providing an acoustical system based on a series of cones, split symmetrically at the vertex, and applied, or otherwise secured, to a flat surface.

BRIEF DESCRIPTION OF THE DRAWINGS

FIG. 1 depicts a plan, partial view of a cone assembly 100 on a base 110.

FIG. 2 depicts a cross-section of FIG. 1 along Line 2—2.

FIG. 3 depicts a front, perspective view of a split cone 120 used in cone assembly 100 on a base 110.

FIG. 4 depicts a rear, perspective view of a split cone 120 used cone assembly 100 on a base 110, which is a reverse view of FIG. 3.

FIG. 5 depicts a top plan view of split cone 120.

Throughout the figures of the drawings, where the same part appears in more than one figure of the drawings, the same number is applied thereto.

DESCRIPTION OF THE PREFERRED EMBODIMENTS

A very effective acoustical shape is now known to be that of a cone. Basically, a cone is a well known geometrical shape. By having the cone split from its vertex to a diameter of its base, half of a cone is created. In other words, the cone is split along its vertical axis.

If the height of the cone from the center of the base to the vertex is longer than the diameter of the base of the cone, an effective acoustical advantage is obtained by halving such a cone along the vertex and applying the halves of the cone to a wall in a typical geometric pattern. The preferred geometrical pattern is customarily vertex to base and edge to edge.

Application of such halves can achieve a substantially even surface and provide for an appropriate acoustical surface. In this fashion, the acoustical values of an area can be improved. A surface composed of half-cone relief tiles will act like coffering (to furnish with sunken panels to break up the surface which acts to eliminate echo and improve the dispersal or diffusion of sound more evenly within the room.)

The invention is an acoustic wall diffusing reflector for home or office use. Utilizing half-cone plaster reflection diffusors (which pour out sound in every direction) thus reduce reverberation. Sonic integrity and interior architectural aesthetics are the features being merged into a balance design.

Three dimensional half-cone sculptural tile shapes molded in plaster. However it is to be noted that the size of the tile will vary dependent upon the scale or size of the area to be filled; thus the larger the space the larger the tile forms. To reiterate, the tile is general shape of a vertically-split half cone.

The half cone preferably has a base surface substantially parallel to a top surface, with the top surface and the base surface connected by a flat connecting plan, and a rounded surface. The top surface is customarily formed by truncating the cone. That is to say the pointed vertex is removed.

In use as an acoustic assembly, the flat connecting surface is adjacent to the wall. The top surface of a half cone is adjacent to a top surface of a second half cone when the half cone is mounted on a wall. The base surface is adjacent to a base surface of a second half cone when the half cone is mounted on a wall.

Preferably, the diameter of the base surface relative to the diameter of the top surface is at a ratio of 1.5 to 5, while a ratio of the height of the flat connecting surface to the diameter of base surface ranges from 7 to 1 to 1 to 1. More preferably, the diameter of the base surface relative to the diameter of the top surface is at a ratio of 1.5 to 4, while a ratio of the height of the flat connecting surface to the diameter of base surface ranges from 6 to 1 to 2 to 1. Most preferably, the diameter of the base surface relative to the diameter of the top surface is at a ratio of 1.5 to 3, while a ratio of the height of the flat connecting surface to the diameter of base surface ranges from 5 to 1 to 2 to 1.

For example, the approximate size of each individual tile or half of a cone with the vertex removed may defined in one form as follows. The cone is about 12 inches long or high, has a diameter of four inches for the base plane, and a diameter of one inch at the top surface. What is previously given is a general use size.

Tile are constructed as single or individual half-cone shapes and are adhered to the surface using tiling mastic. Thus installation resembles that of general tile installation technique.

Creation or enhancement within the sound space of the home or office in which audio and video elements are to be employed is thus achieved. It is proposed that the introduction of low-cost sonic reflecting walls created from half-cone plaster tiles will improve sound quality and will enhance the aesthetics of the architectural space in which the device is placed.

The created conditions for good optimum hearing conditions within a room must provide adequate loudness, with minimal sound dampening material. There must also be no perceptible echoes or focusing and no undue reverberation.

The serrated layout of the acoustic half-cone plaster wall tiles provides beneficial diffusion of sound by reducing the most common of acoustic problems—that of reverberation. The serrated layout of the plaster cones functions or acts as a diffusing reflector system within an enclosed space; thus the final goal is achieved through their use.

Where music is concerned the room must be non-resonant and as uniformly reverberant as possible for sound of all musical pitches.

Acoustic cones placed into the wall can make the flat surface of a wall less rectangular and more dimensional and thereby greatly expands the surface area of the wall itself which can thereby re-shape room space so that modes of vibration are distributed in a more complex way making them more irregular. Thereby modes of vibration are less likely to coincide (take up the same space). This effectively broadens the tuning of the room modes and makes them likely to coalesce (merge) than they might within a room with all flat surface walls.

The relationship between sound-absorbing and sound-reflecting material must balance. The reflective action of sound within an auditorium is generally rendered satisfactory through the introduction of splayed walls. For example, theater walls spread out or spread apart thus expanding the wall surface area.

This invention for home or office audio and video also splays out the wall through the use of relief forms which extend the surface by spreading and turning the wall forms outward thus expanding the wall surface area greatly. To secure adequate dispersal, the plaster half-cones are created sufficiently deep to be effective for home or office use and, thus, function as diffusing reflectors.

Rooms which have plain unbroken surfaces are very subject to excessive reverberation. Plastic half-cone tile to reduce the effects of excessive reverberation. For good acoustic conditions, the time of reverberation must be short. Thus, a variety of absorbing materials must be present in sufficient quantity, and sufficient dimension while having even distribution throughout the room.

Plaster acoustic half-cone tiles also are effective in dispersing high frequency waves from a flat reflective wall surface. The half-cone tile create a fluted or pipe network, which is well known and useful in dispersing or diffusing frequency waves from reflecting surfaces. Examples of fluted or pipe work formed in manners are often seen in movie theaters.

Referring now to FIG. 1 and FIG. 2, a cone assembly 100 on a base 110 formed by a series of split cones 120. The split cones 120 are assembled top to top and bottom in a uniform geometrical pattern as shown.

Adding FIG. 3, FIG. 4, and FIG. 5 to the consideration, the shape of the split cone 120 may be seen more clearly. More specifically, considering FIGS. 1, FIG. 2 and FIG. 3 together, the split cone 120 has a rounded surface 130 which is visible on base 110. A flat connecting surface 132 forms the other side thereof. The rounded surface 130 and the flat connecting surface 132 combine to connect the base surface 134 to the top surface 136.

Top surface 136 is formed by slightly truncating the cone (not shown) before or after it is split into split cone 120. It is clear that the tip of the cone has been removed, to thereby truncate the cone.

Referring back to FIG. 1 and FIG. 2, the split cone 120 can be secured to a first side 114 of base 110 at flat connecting surface 132. Second side 116 of base 110 is then supported on wall surface 112.

Base 110, and in particular second side 114 can be permanently or removably secured to wall surface 112. If permanently secured, cone assembly 100 and the acoustical results thereof are permanently in place. If removably secured, cone assembly 100 can be applied or removed as desired. This assembly produces the desired conical effect and acoustical results preferred.

The following examples are intended to illustrate, without unduly limiting this invention.

EXAMPLE 1

A room having the dimensions of 12 feet by 12 feet by 8 feet is enclosed. A standard stereo system is arranged in the room. Sound monitors are positioned in the room to analyze the sound emanating from the stereo system. The stereo system creates a factor indicating somewhat pleasant sound.

EXAMPLE 2

The room of Example 1 is modified by covering the walls in the pattern indicated in FIG. 1 and FIG. 2 with a cone assembly 100 on base 110. Base 110 is secured to wall surface 112 prior to cone assembly 100 being attached thereto. The same piece of music from Example 1 is then played on the stereo system. The equipment indicates a much more efficient sound production from the stereo system.

EXAMPLE 3

The room of Example 1 is modified by moving along the four walls thereof panels supporting the cones. In this fashion, the base 110 is a separate entity from the wall surface 112 and the base 110 with cone assembly 100 may be moved in and out of, or assembled in the room as desired. The same piece of music from Example 1 is then played on the stereo system. The equipment indicates a much more efficient sound production from the stereo system.

This application—taken as a whole with the specification, claims, abstract, and drawings—provides sufficient information for a person having ordinary skill in the art to practice the invention disclosed and claimed herein. Any measures necessary to practice this invention are well within the skill of a person having ordinary skill in this art after that person has made a careful study of this disclosure.

Because of this disclosure and solely because of this disclosure, modification of this method and device can become clear to a person having ordinary skill in this particular art. Such modifications are clearly covered by this disclosure.

What is claimed and sought to be protected by Letters Patent of the United States is:

1. An acoustical assembly comprising:

(a) at least one cone being split along a vertical axis of symmetry to form a first cone half and a second cone half;

(b) a wall surface receiving the first cone half and the second cone half; and (c) the wall surface being substantially covered with the at least one cone split along the vertical axis.

2. The acoustical assembly of claim 1 further comprising:

(a) the at least one cone being a sufficient number of cones to cover an entire area of the wall surface;

(b) the wall surface being thus substantially covered with half-cone relief tiles to act as coffering to break up the wall surface; and (c) the coffering serving to eliminate echo and improve dispersal or diffusion of sound more evenly within a room.

3. The acoustical assembly of claim 2 further comprising:

(a) the at least one cone having a composition of plaster; and (b) the first cone half and the second cone half providing sonic integrity and interior architectural aesthetics to the wall surface.

4. The acoustical assembly of claim 3 further comprising:

(a) the first cone half and the second cone half being mutually symmetrical;

(b) the first half cone having a base surface substantially parallel to a top surface;

(c) the top surface and the base surface being joined by a flat connecting planar surface, and a rounded surface; and (c) the flat connecting planar surface, and the rounded surface mutually adjacent.

5. The acoustical assembly of claim 4 further comprising:

(a) the flat connecting surface being adjacent to the wall surface;

(b) the first cone half and the second cone half further including at least a third half cone, a fourth half cone, a fifth half cone and a sixth half cone;

(c) the first cone half, the second cone half the third cone half, a fourth cone half, a fifth cone half and a sixth cone half being mutually symmetrical;

(d) the first half cone being truncated to form a first top surface and a first base surface substantially perpendicular to both the flat connecting planar surface and the rounded surface;

(e) the second half cone being truncated to form a second top surface and a second base surface substantially perpendicular to both the flat connecting planar surface and the rounded surface; and (f) the first half cone having the first base surface thereof adjacent to the second base surface.

6. The acoustical assembly of claim 5 further comprising:

(a) a diameter of the first base surface relative to a diameter of the first top surface being at a ratio of 1.5 to 5; and (b) a height of the flat connecting surface to the diameter of first base surface ranges from 7 to 1, to 1 to 1.

7. The acoustical assembly of claim 6 further comprising:

(a) a diameter of the first base surface relative to a diameter of the first top surface being at a ratio of 1.5 to 4; and (b) a height of the flat connecting surface to the diameter of the first base surface ranges from 6 to 1, to 2 to 1.

8. The acoustical assembly of claim 7 further comprising:

(a) a diameter of the first base surface relative to a diameter of the first top surface being at a ratio of 1.5 to 3; and (b) a height of the flat connecting surface to the diameter of first base surface ranges from 5 to 1, to 2 to 1.

9. The acoustical assembly of claim 7 further comprising:

(a) the first top surface being formed upon removal of a vertex of the cone; and (b) the cones being formed of plaster.

10. An acoustical assembly comprising:

(a) at least one cone being split along a vertical axis of symmetry to form a first cone half and a second cone half;

(b) a movable surface receiving the first cone half and the second cone half;

(c) the movable surface being substantially covered with the at least one cone split along the vertical axis;

(d) the at least one cone being a sufficient number of cones to cover an entire area of the movable surface;

(e) the movable surface being thus composed of half-cone relief tiles to act as coffering to break up the movable surface; and (f) the coffering serving to eliminate echo and improve dispersal or diffusion of sound more evenly within a room.

11. The acoustical assembly of claim 10 further comprising:

(a) the at least one cone having a composition of plaster; and (b) the first cone half and the second cone half providing sonic integrity and interior architectural aesthetics to the movable surface.

12. The acoustical assembly of claim 11 further comprising:

(a) the first cone half and the second cone half being mutually symmetrical;

(b) the first half cone being truncated;

(c) the first half cone having a first base surface substantially parallel to a first top surface;

(d) the first top surface and the first base surface being joined by a flat connecting planar surface, and a rounded surface; and (e) the flat connecting planar surface, and the rounded surface mutually adjacent.

13. The acoustical assembly of claim 12 further comprising:

(a) the flat connecting surface being adjacent to the wall surface;

(b) the first cone half and the second cone half further including at least a third cone half, a fourth cone half, a fifth cone half and a sixth cone half;

(c) the first cone half, the second cone half the third cone half, a fourth cone half, a fifth cone half and a sixth cone half being mutually symmetrical;

(d) the first cone half having the top surface thereof adjacent to a second top surface of a second cone half; and (e) the first half cone having the first base surface thereof adjacent to a second base surface of the second half cone.

14. The acoustical assembly of claim 13 further comprising:

(a) a diameter of the first base surface relative to a diameter of the first top surface being at a ratio of 1.5 to 5; and (b) a height of the flat connecting surface to the diameter of first base surface ranges from 7 to 1, to 1 to 1.

15. The acoustical assembly of claim 14 further comprising:

(a) a diameter of the first base surface relative to a diameter of the first top surface being at a ratio of 1.5 to 4; and (b) a height of the flat connecting surface to the diameter of first base surface ranges from 6 to 1, to 2 to 1.

16. The acoustical assembly of claim 15 further comprising:

(a) a diameter of the first base surface relative to a diameter of the first top surface being at a ratio of 1.5 to 3; and (b) a height of the flat connecting surface to the diameter of first base surface ranges from 5 to 1, to 2 to 1.

17. The acoustical assembly of claim 16 further comprising:

(a) the first top surface being formed upon removal of a vertex of the cone; and (b) the cones being formed of plaster.

18. A method of forming an acoustical assembly comprising:

(a) providing at least one cone being split along a vertical axis of symmetry to form a first cone half and a second cone half;

(b) applying the first cone half and the second cone half to a surface;

(c) covering the surface with series of the first cone half and the second cone half in geometrical pattern.

19. The method of claim 18 further comprising the surface being at least one wall of a room.

20. The method of claim 19 further comprising the cone being truncated.

* * * * *